US008607542B2

(12) United States Patent
Mason

(10) Patent No.: US 8,607,542 B2
(45) Date of Patent: Dec. 17, 2013

(54) VALVELESS PULSE COMBUSTOR

(75) Inventor: Samuel Alexander Mason, Derby (GB)

(73) Assignee: Rolls-Royce PLC (GB)

( * ) Notice: Subject to any disclaimer, the term of this patent is extended or adjusted under 35 U.S.C. 154(b) by 1150 days.

(21) Appl. No.: 12/143,907

(22) Filed: Jun. 23, 2008

(65) Prior Publication Data

US 2011/0056182 A1 Mar. 10, 2011

(30) Foreign Application Priority Data

Jul. 28, 2007 (GB) ..... 0714814.1

(51) Int. Cl.
*F02C 5/11* (2006.01)

(52) U.S. Cl.
USPC ..... 60/39.76; 60/248

(58) Field of Classification Search
USPC ..... 60/247–249, 39.38, 770, 39.76–39.77; 431/1
See application file for complete search history.

(56) References Cited

U.S. PATENT DOCUMENTS

| | | | | | |
|---|---|---|---|---|---|
| 2,587,227 | A | * | 2/1952 | Roy | 244/74 |
| 2,860,484 | A | * | 11/1958 | Schmidt | 60/39.77 |
| 2,998,705 | A | * | 9/1961 | Porter et al. | 60/249 |
| 3,188,804 | A | | 6/1965 | Melenric | |
| 3,354,650 | A | | 11/1967 | Malroux | |
| 3,768,926 | A | | 10/1973 | Pegg et al. | |
| 3,819,318 | A | * | 6/1974 | Pearson | 431/1 |

* cited by examiner

*Primary Examiner* — Andrew Nguyen
(74) *Attorney, Agent, or Firm* — McCormick, Paulding & Huber LLP

(57) ABSTRACT

A valveless pulse combustor having a combustion chamber with a closed first end and an open second end, the combustor also having a tailpipe in fluid communication with the open second end of the combustion chamber, the combustor further having an inlet pipe in fluid communication with the open second end of the combustion chamber, the inlet pipe and the tailpipe being arranged such that one is located within the other.

28 Claims, 4 Drawing Sheets

VALVELESS PULSE COMBUSTOR

CROSS REFERENCE TO RELATED APPLICATION

This application is entitled to the benefit of British Patent Application No. GB 0714814.1 filed on Jul. 28, 2007.

FIELD OF THE INVENTION

The present invention relates to valveless pulse combustors. More particularly, it is concerned with the inlet pipe and tailpipe of such combustors and the casing for surrounding them. It is particularly, but not exclusively, concerned with valveless pulse combustors for gas turbine engine applications.

BACKGROUND OF THE INVENTION

A pulse combustor operates by producing a series of discrete combustion events rather than a continuous combustion level as is seen in a conventional gas turbine combustion system. These combustions events drive an unstable fluid-dynamic longitudinal mode of vibration, which is evidenced by the pressure in the combustion chamber alternating between high and low pressure. The timing of these combustion events is controlled by the acoustic resonance of the fluid in the combustor, which itself is determined by the geometry of the combustor. The vibration is also evidenced by air in the inlet pipe and tailpipe alternating between forward and reverse flow so that air is periodically ingested and exhausted through both the inlet pipe and tailpipe. A valveless pulse combustor does not comprise mechanical valves. Instead, by virtue of the inlet pipe being substantially shorter than the tailpipe, the air in the inlet pipe offers greater acoustic impedance than the air in the tailpipe. Thus, combustion products are preferentially driven from the combustion chamber to the tailpipe and there is a net flow of air from the inlet pipe to the tailpipe. This is the mechanism by which the valveless pulse combustor self-aspirates.

Since some propulsive force is generated by gas exhaust through the inlet pipe, as well as that generated by the tailpipe exhaust, a mechanism is required to direct the inlet exhaust in a rearward direction. Lockwood-Hiller type combustors use a U-shaped tailpipe and a straight inlet pipe, both pointing rearwardly at their open end. One problem with this arrangement is that there are losses generated by turning the working flow through 180° in the tailpipe.

Kentfield (U.S. Pat. No. 4,033,120) discloses a forward facing inlet pipe and a rearwardly facing tailpipe. It also discloses an inlet-driven ejector that resembles a U-shaped tube with one end coaxial with and spaced apart from the inlet pipe end and the other end approximately parallel to the end of the tailpipe and directed in the same general direction.

One disadvantage of this arrangement is that the combustor is long compared to alternative combustor types. This is particularly disadvantageous for a gas turbine engine application due to the consequent increases in shaft lengths and overall weight.

A further disadvantage of this arrangement is that the first section of the tailpipe, nearest to the combustion chamber, experiences a very high rate of heat transfer and thus tends to get very hot. This problem is exacerbated in a gas turbine engine application since there is generally a shroud, or casing, surrounding the combustor and designed to limit rejection of heat through radiation. Thus, additional cooling may well be required which can cause a substantial penalty in the engine performance.

The present invention seeks to provide a novel valveless pulse combustor that seeks to address the aforementioned problems.

SUMMARY OF THE INVENTION

Accordingly, the present invention provides a valveless pulse combustor having a combustion chamber with a closed first end and an open second end, the combustor also having a tailpipe in fluid communication with the open second end of the combustion chamber, the combustor further having an inlet pipe in fluid communication with the open second end of the combustion chamber, the inlet pipe and tailpipe being arranged such that one is located within the other.

Preferably, the tailpipe is located within the inlet pipe. More preferably, the tailpipe is coaxial with the inlet pipe.

Preferably, the inlet pipe is divergent away from the combustion chamber. Preferably the tailpipe is divergent away from the combustion chamber.

Preferably, any one or more of the combustion chamber, the inlet pipe and the tailpipe are tubular in cross-section. Alternatively, any one or more of the combustion chamber, the inlet pipe and the tailpipe are annular in cross-section.

Preferably, the combustor further comprises a casing surrounding the combustion chamber, inlet pipe and tailpipe. Preferably, the casing is tubular or annular in cross-section.

The combustor can bend through an included angle $\alpha$ between an inlet and an outlet. Preferably, the tailpipe bends through the included angle $\alpha$. Alternatively, the inlet pipe bends through the included angle $\alpha$. Preferably, the included angle $\alpha$ is in the range 0° to 180°.

Preferably, there is a casing having at least one annular ejector aligned with the outlet of the tailpipe and/or the inlet of the inlet pipe, the at least one annular ejector is arranged to entrain gases to smooth pressure fluctuations in the gases.

Preferably, the casing is formed as a tubular casing. Alternatively, the casing is formed as an inner casing and an outer casing. Preferably, each of the inner and outer casings has first and second ejectors. The inner and outer casings may be joined at least at a gas inlet position.

The casing may bend through an included angle $\alpha$ between an inlet and an outlet. The included angle $\alpha$ is in the range 0° to 180°.

Preferably, the at least one ejector comprises a convergent portion, a throat, a mixing zone and a divergent portion. Preferably, the throat is arranged downstream of the inlet of the inlet pipe or downstream of the tailpipe.

A second aspect of the present invention provides a valveless pulse combustor casing having at least one annular ejector comprising a convergent portion, a throat, a mixing zone and a divergent portion. Preferably, there are first and second annular ejectors, the second ejector being spaced axially from the first ejector. Preferably, the throat is arranged downstream of the inlet of the inlet pipe or downstream of the tailpipe.

Preferably, the casing is formed as a tubular casing. Alternatively, it is formed as an inner casing and an outer casing. Preferably, each of the inner and outer casings has first and second annular ejectors. The inner and outer casings may be joined at least at a gas inlet portion.

The casing may bend through an included angle $\alpha$ between an inlet and an outlet. Preferably, the included angle $\alpha$ is in the range 0° to 180°.

DETAILED DESCRIPTION OF THE PREFERRED EMBODIMENTS

Figure 1:
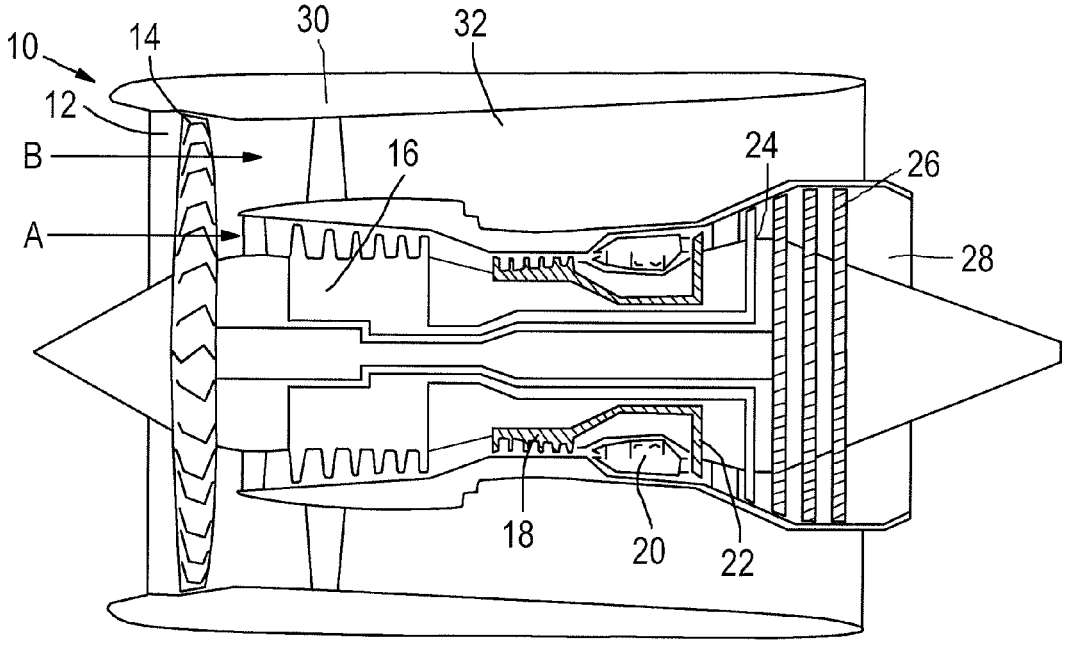
FIG. 1 is a sectional side view of a gas turbine engine.

A gas turbine engine 10 is shown in FIG. 1 and comprises an air intake 12 and a propulsive fan 14 that generates two airflows A and B. The gas turbine engine 10 comprises, in axial flow A, an intermediate pressure compressor 16, a high pressure compressor 18, combustion equipment 20 according to the present invention, a high pressure turbine 22, an intermediate pressure turbine 24, a low pressure turbine 26 and an exhaust nozzle 28. A nacelle 30 surrounds the gas turbine engine 10 and defines, in axial flow B, a bypass duct 32.

Figure 2:
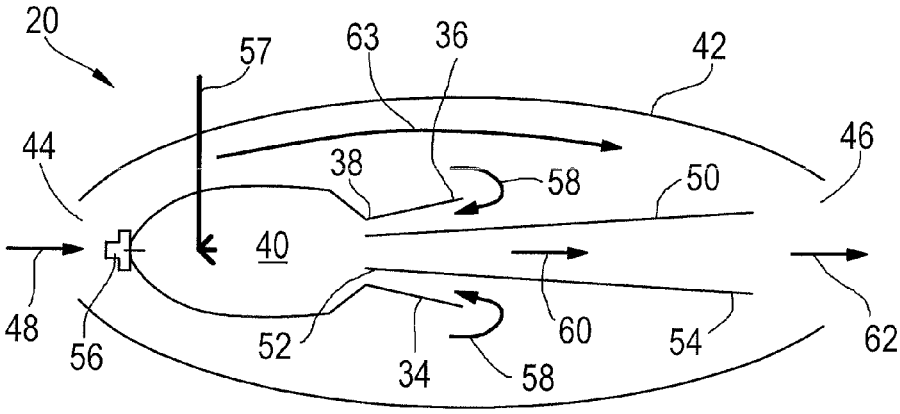
FIG. 2 is a schematic side view of a combustor according to the present invention.

An exemplary embodiment of the combustion equipment 20 of the present invention is shown in FIG. 2. The combustion equipment 20 is positioned within an annular casing 42 that has an inlet 44 and an outlet 46. In use, air enters the combustion equipment 20 through the inlet 44 as indicated by arrow 48. Typically, the air is provided from the compressor stages, particularly the high-pressure compressor 18. The combustion equipment 20 comprises a combustion chamber 40, which has a closed first end and an open second end. The combustion equipment 20 also comprises an inlet pipe 34 with a first end 36 and a second end 38. The second end 38 is connected to the second end of the combustion chamber 40 to provide flow communication between the inlet pipe 34 and the combustion chamber 40. The first end 36 of the inlet pipe 34 is rearwardly facing, downstream in terms of the fluid flow direction through the engine; thus, the first end 36 of the inlet pipe 34 is further downstream than the second end 38.

The combustion equipment 20 further comprises a tailpipe 50 having first and second ends 52, 54. The first end 52 is positioned at the open second end of the combustion chamber 40 to provide fluid communication between the combustion chamber 40 and the tailpipe 50. The second end 54 is located further downstream than the first end 52 and further downstream than the first end 36 of the inlet pipe 34 so that the tailpipe 50 is longer than the inlet pipe 34. Hence, both the first end 36 of the inlet pipe 34 and the second end 54 of the tailpipe 50 are positioned between the open second end of the combustion chamber 40 and the outlet 46 of the casing 42 and extend generally in the downstream direction towards outlet 46 of the combustion equipment casing 42.

The tailpipe 50 is located coaxially within the inlet pipe 34 so that the inlet pipe 34 surrounds at least a first portion of the tailpipe 50. This shortens the overall length of the combustion equipment 20 in comparison with prior art pulse combustion equipment with the resultant benefits in terms of shorter shafts in the gas turbine engine 10, lighter weight combustion equipment 20 and a lighter weight gas turbine engine 10 overall. Since both the inlet pipe 34 and the tailpipe 50 are rearward facing the working fluid is not turned through 180° in the tailpipe 50 and therefore the losses associated with this are avoided.

In operation, air flows into the inlet pipe 34 and the tailpipe 50 to saturate the combustion chamber 40. The inlet pipe 34 and the tailpipe 50 are also filled with air during this part of the combustion cycle. When the combustion event occurs in the combustion chamber 40, hot combustions gases are expelled primarily through the tailpipe 50, due to its larger diameter bore, as shown by arrows 60. The combustion event pushes the air filling the inlet pipe 34 ahead of the hot combustion products in a downstream direction out through the inlet pipe 34 as shown by arrows 61. Thus, this flow 61 substantially comprises the relatively cool inlet flow 58 reversed and expelled rather than hot combustion products. In contrast, the tailpipe 50 has a larger diameter bore so the incoming air flow is reversed and expelled fairly rapidly leaving the flow 60 to primarily comprise the hot combustion products generated by the combustion event.

A further benefit of the arrangement of the present invention is available because the air flowing through the inlet pipe 34, indicated by arrows 58 and 61 (FIG. 4), is relatively cool. Since the inlet pipe 34 surrounds the hottest part of the tailpipe 50, the air flows 58 and 61 cool the hottest part of the tailpipe 50 and the combustion products flowing therethrough, indicated by arrow 60, which improves the life of the components. The cooling effect is further improved by the unsteady nature of the cool inlet pipe flow 58, 61 since the unsteadiness of the flow increases the heat transfer coefficient leading to more effective cooling. The air 48 entering the combustion equipment 20 washes over the external surface of the combustion chamber 40 before entering the inlet pipe 34 as flow 58, and thus provides some cooling of the combustion chamber 40 as well. It is to be noted that some of the air flow 48 entering the combustion equipment 20 bypasses the combustion chamber 40 and flows towards the outlet 46*b* of the casing 42 to form a bypass flow 63.

The combustion chamber 40 may also be provided with conventional ignition means 56 and fuel delivery equipment 57 as is well known in the art. Combustion products exit the combustion equipment 20 via the outlet 46 in the combustion equipment casing 42 as exit flow 62. The valveless pulse jet combustion equipment 20 works in conventional manner and so the exit flow 62 is comprised of exhaust gas flow 61 from the inlet pipe 34, combustion products flow 60 from the tailpipe 50 and the bypass flow 63.

The inlet pipe 34 and tailpipe 50 are secured to the casing 42 by any suitable means (not shown), for example by one, or preferably more, vanes or struts distributed around the exterior surface of the tailpipe 50 between its first and second ends 52, 54 and similar vanes or struts extending between the exterior surface of the tailpipe 50 and the interior surface of the inlet pipe 34 between the first and second ends 36, 38 of the inlet pipe 34. However, other methods of securing and locating the inlet pipe 34 and tailpipe 50 relative to the combustion chamber 40 and the casing 42 can be used as are well known in the art.

Figure 3:
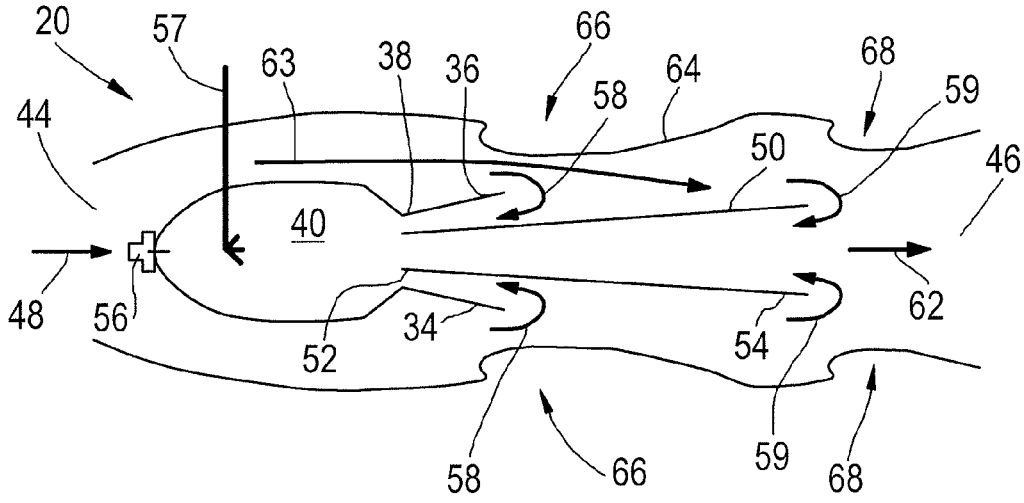
FIG. 3 is a schematic side view of a combustor and casing according to the present invention in a first phase of operation.
Figure 4:
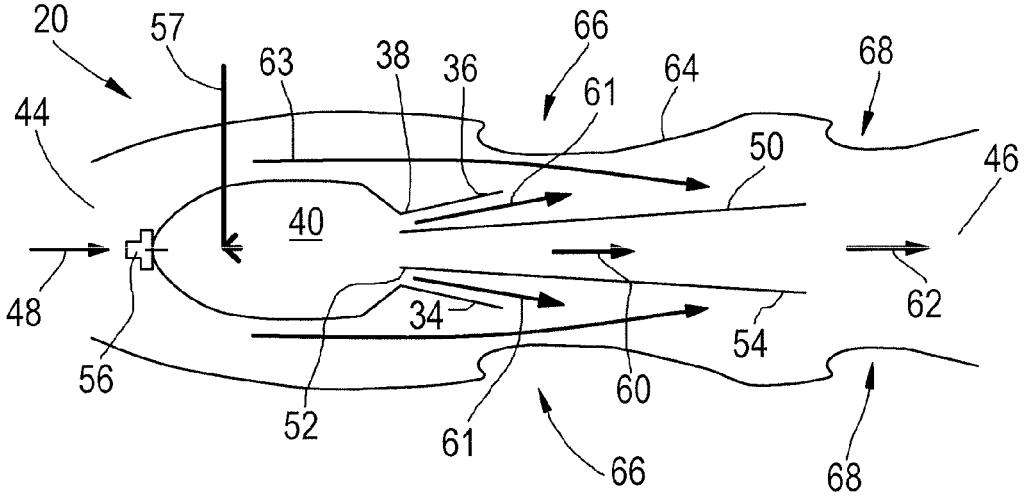
FIG. 4 is a schematic side view of a combustor and casing according to the present invention in a second phase of operation.

FIG. 3 and FIG. 4 show a second aspect of the present invention in two phases of operation. The combustion equipment 20 comprises the same components as described with respect to FIG. 2 and operates in the same manner. However, instead of the standard combustion equipment casing 42 shown in FIG. 2, a modified combustion equipment casing 64 is shown in FIG. 3 and FIG. 4. The profile of the casing 64 is arranged to include two annular ejectors 66, 68. The first annular ejector 66 is coaxial with the first end 36 of the inlet pipe 34 whilst the second annular ejector 68 is coaxial with the second end 54 of the tailpipe 50. Each ejector 66, 68 is integral to the casing and acts to smooth pressure fluctuations in the exhaust gas flow 61 exiting the inlet pipe 34 and the combustion products flow 60 exiting the tailpipe 50. The diameter of the first ejector 66 is approximately twice the inlet pipe 34 diameter; similarly, the diameter of the second ejector 68 is approximately twice the tailpipe 50 diameter.

Figure 5:
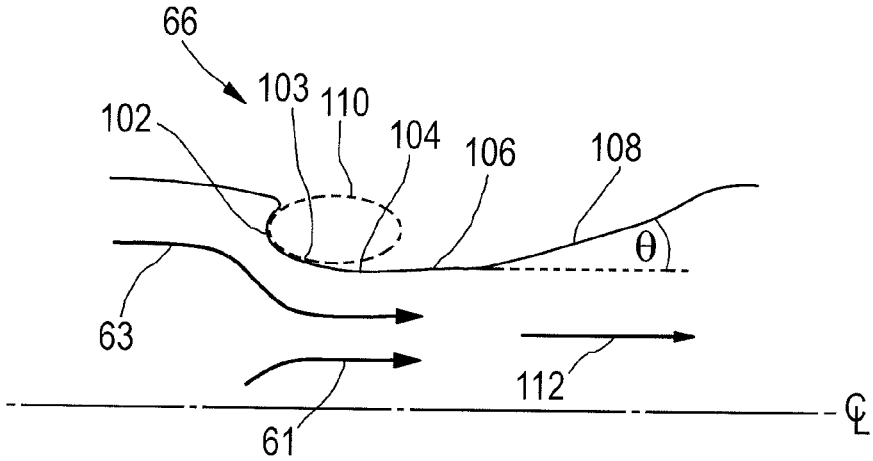
FIG. 5 is a schematic side view of an ejector formed in the casing of a combustor according to the present invention.

Part of the first ejector 66 is shown in FIG. 5 and comprises a leading edge 102, a converging section 103, a throat 104, a mixing zone 106 and a diffuser section 108 radially distant from the centreline $C_L$ of the combustion equipment 20. The converging section 103 between the leading edge 102 and the throat 104 is shaped as part of a circle or ellipse, such as dotted outline 110, to provide a smooth aerodynamic surface over which the entrained flow can be accelerated without causing the boundary layer to separate. The throat 104 is the minimum cross-sectional area location that is immediately downstream of the converging section 103 and the first end 36 of the inlet pipe 34. Immediately downstream of the throat 104 is a constant cross-sectional area mixing zone 106. Downstream of the mixing zone 106 is the diffuser section 108, which has an increasing cross-sectional area in the downstream direction. The diffuser section 108 has an included angle $2\theta$. Typically, $\theta$ is no greater than 12°.

When the exhaust gas flow 61 exits the inlet pipe 34 and enters the first ejector 66, it mixes with the slower moving bypass air 63, which causes the static pressure to increase in the downstream direction. Thus, there is a region of relatively low pressure in the throat 104 and the mixing zone 106 compared with further upstream and the air is thus entrained and mixed with the exhaust gas flow 61 in the mixing zone 106. The diffuser section 108 causes a further increase in static pressure and a resultant increase in entrainment. This entrainment continues following flow reversal when air flows into the inlet pipe 34 as flow 58. Hence, the downstream flow 112 is steadier than the exhausted gas flow 61. The second ejector 68 is substantially the same as the first ejector 66 and works in a similar way with the flow of hot combustion products 60 from the tailpipe 50 instead of the flow of exhaust gases 61 from the inlet pipe 34.

The shape of the ejectors is chosen to maximise the efficiency with which the kinetic energy is transferred from the exhaust gas flow 61, or the combustion products flow 60, to the entrained downstream flow 112 of the ejectors 66, 68. The design of efficient ejectors is known in the art (e.g., Mason S. A. and Miller, R. J., *The performance of ejectors driven by sinusoidally unsteady jets*, AIAA paper 2006-1020, presented at $44^{th}$ aerospace sciences meeting, Reno).

Providing ejectors 66, 68 that are integrally formed with the casing reduces the number of parts used in the combustion equipment 20. This therefore reduces the weight and cost of the combustion equipment 20. The first annular ejector 66 smoothes pressure fluctuations from the inlet pipe 34 and therefore reduces or prevents backflow into the upstream high-pressure compressor 18 and other components. The second annular ejector 68 smoothes pressure fluctuations from the tailpipe 50 and therefore reduces or prevents pressure fluctuations being transmitted to downstream components including the high-pressure turbine 22.

The arrangement of the present invention is particularly beneficial because it uses to its advantage the unsteady flow in the inlet pipe 34 to improve the self-cooling capability compared to prior art arrangements. Following this, the flows are smoothed by the ejectors 66, 68 so that adjacent components are substantially insulated from the unsteady flow.

The combustion arrangement shown in FIG. 3 and FIG. 4 is a fully tubular combustion arrangement wherein each tubular combustion chamber 40 is housed within its own tubular casing 64. There may be an array of these tubular combustion arrangements in a gas turbine engine, for example a plurality of equi-circumferentially spaced tubular combustion arrangements arrayed coaxially around the shafts connecting the fan 14 and compressors 16, 18 to the turbines 22, 24, 26.

Figure 6:
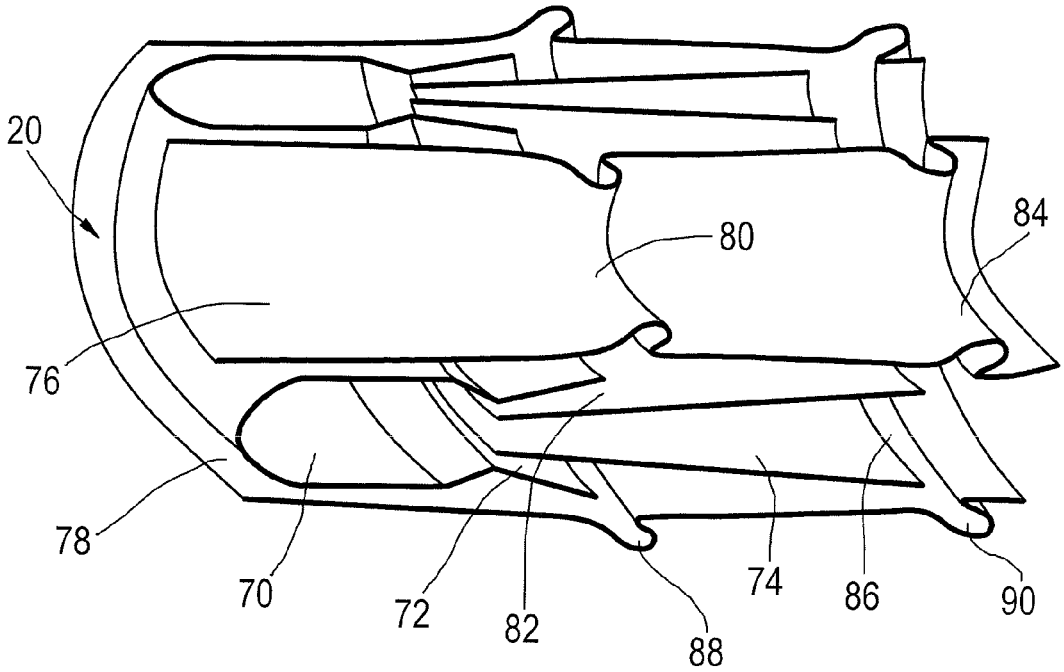
FIG. 6 is a perspective view of a portion of an annular combustor and casing according to the present invention.

Alternatively, the present invention may be embodied in a fully annular arrangement, a portion of which is shown in FIG. 6. The combustion equipment 20 comprises an annular combustion chamber 70 in fluid communication with an annular inlet pipe 72 and a coaxial annular tailpipe 74. As before, fuel delivery equipment and ignition means (not shown) are provided as are well known in the art. Surrounding the combustion chamber 70, inlet pipe 72 and tailpipe 74 is the casing, which comprises an inner annular casing 76 and an outer annular casing 78. The inner casing 76 has a first annular ejector 80 coaxial with the first end 82 of the inlet pipe 72. The inner casing 76 also has a second annular ejector 84 coaxial with the second end 86 of the tailpipe 74. Similarly, the outer casing 78 has a first annular ejector 88 coaxial with the first end 82 of the inlet pipe 72 and a second annular ejector 90 coaxial with the second end 86 of the tailpipe 74.

A further alternative arrangement of the combustion equipment 20 and casing of the present invention combines the arrangements of FIG. 3 and FIG. 6 by having an annular array of tubular combustors, as shown in FIG. 2, 3 or 4, surrounded by the annular inner and outer casing 76, 78 of FIG. 6.

Figure 7:
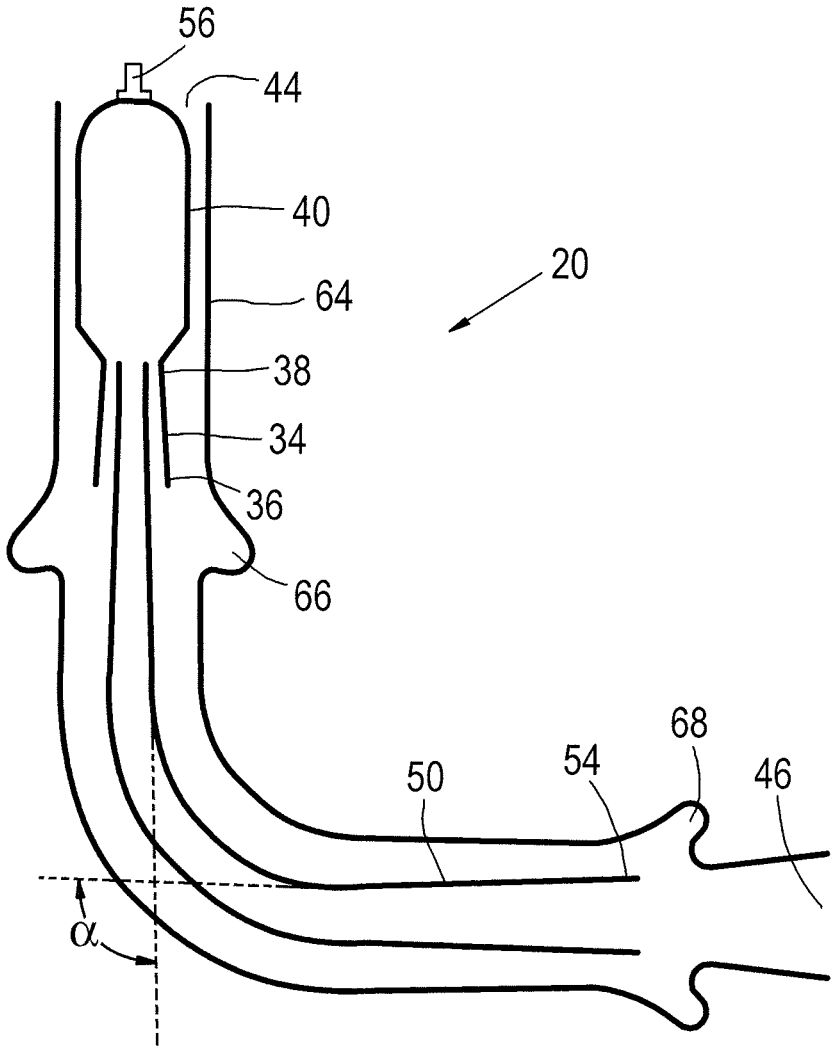
FIG. 7 is a schematic side view of a further embodiment of a combustor and casing according to the present invention.

FIG. 7 shows a further embodiment of a tubular combustor and casing according to the present invention. As in previous figures, there is a combustion chamber 40 having an inlet pipe 34 extending from the downstream end of the combustion chamber 40 and a tailpipe 50 positioned coaxially within the inlet pipe 34. The combustion chamber 40 also includes ignition means 56 and fuel delivery equipment (not shown) as are well known in the art. The casing 64 resembles that of FIG. 3 in that it has integrally formed ejectors 66, 68 respectively located coaxial with the first end 36 of the inlet pipe 34 and coaxial with the second end 54 of the tailpipe 50. The arrangement of FIG. 7 differs from that shown in FIG. 3 in that there is a bend in the tailpipe 50 and downstream portion of the casing 64 such that the inlet 44 of the casing 64 is not coaxial with the outlet 46 of the casing 64. The tailpipe 50 and casing 64 bend at an included angle labelled $\alpha$. In this figure, $\alpha$ is 90° to give a radial inflow combustor. This arrangement may be advantageous in some applications, such as gas turbines featuring radial compressors.

In principle the angle $\alpha$ may be any angle between 0° (as shown in FIG. 3) to 180° (a reverse flow combustor). The latter may shorten the overall length of the combustion equipment 20, although there may be losses associated with turning the flows by 180°. Reverse flow combustors are sometimes used in helicopter engines where they provide a very compact installation.

Although the annular casing 76, 78 has been described as separate components, the inner 76 and outer 78 casings may be joined at the upstream end. In this case, an array of apertures is provided in the upstream end surface to enable the air to enter the combustion equipment 20.

Although more benefit is derived from implementing the present invention with both integral ejectors, coaxial with the inlet pipe and the tailpipe, it is possible to derive some of the benefits by providing only one of the ejectors. Preferably, the inlet-driven ejector 66 or 80, 88 is provided as this captures much of the kinetic energy in the flow of exhaust gases 61 from the inlet pipe 34, 72 and prevents it being lost.

The bent combustor shown in FIG. 7 is bent in the region of the tailpipe 50 between the first and second annular ejectors 66, 68 of the casing 64. Although this is the preferred embodiment, since there is little complex geometry to bend, other bend locations are possible. For example, it is also possible to derive the benefits of the present invention by bending the combustor at a location between the first and second ends 36, 38 of the inlet pipe 34.

Although the embodiments of the present invention have been described with respect to tubular or annular components, other shapes can be conceived and fall within the scope of the invention as claimed. For example, any one or more of the combustion chamber 40, the inlet pipe 34, the tailpipe 50 and the casing 42 may have a square, rectangular, triangular or other polygonal cross-section. Preferably, the components are regularly shaped although a-symmetrical shapes could be contemplated. Similarly, although it is preferred that the inlet pipe 34, tailpipe 50, combustion chamber 40 and casing 42 are coaxial for at least some of their length, one or more of these components may be non-coaxially aligned.

What is claimed is:

1. A valveless pulse combustor comprising:

a combustion chamber with a closed first end and an open second end;

a tailpipe in fluid communication with the open second end of the combustion chamber;

an inlet pipe in fluid communication with the open second end of the combustion chamber;

a casing surrounding the combustion chamber, inlet pipe, tail pipe, and the closed first end of the combustion chamber, the casing having at least one annular ejector axially aligned with at least the inlet of the inlet pipe, the at least one annular ejector comprising a convergent portion, a throat, a mixing zone, and a divergent portion and arranged to receive a bypass flow and entrain gases to smooth pressure fluctuations in the gases; and the inlet pipe and the tailpipe being arranged such that one is located within the other.

2. A valveless pulse combustor as claimed in claim 1 wherein the tailpipe is located within the inlet pipe.

3. A valveless pulse combustor as claimed in claim 1 wherein the tailpipe is coaxial with the inlet pipe.

4. A valveless pulse combustor as claimed in claim 1 wherein the inlet pipe is divergent away from the combustion chamber.

5. A valveless pulse combustor as claimed in claim 1 wherein the tailpipe is divergent away from the combustion chamber.

6. A valveless pulse combustor as claimed in claim 1 wherein any one or more of the combustion chamber, the inlet pipe and the tailpipe are tubular in cross-section.

7. A valveless pulse combustor as claimed in claim 1 wherein any one or more of the combustion chamber, the inlet pipe and the tailpipe are annular in cross-section.

8. A valveless pulse combustor as claimed in claim 1 wherein the casing is tubular in cross-section.

9. A valveless pulse combustor as claimed in claim 1 wherein the casing is annular in cross-section.

10. A valveless pulse combustor as claimed in claim 1 wherein the combustor bends through an included angle .alpha. between an inlet and an outlet of the combustor.

11. A valveless pulse combustor as claimed in claim 10 wherein the inlet pipe bends through the included angle .alpha. between the inlet and the outlet of the combustor.

12. A valveless pulse combustor as claimed in claim 10 wherein the tailpipe bends through the included angle .alpha. between the inlet and the outlet of the combustor.

13. A valveless pulse combustor as claimed in claim 10 wherein the included angle .alpha. is in the range 0.degree. to 180.degree.

14. A valveless pulse combustor as claimed in claim 1 wherein the casing is formed as a tubular casing.

15. A valveless pulse combustor as claimed in claim 1 wherein the casing is formed as an inner casing and an outer casing.

16. A valveless pulse combustor as claimed in claim 15 wherein each of the inner and outer casings has first and second annular ejectors.

17. A valveless pulse combustor as claimed in claim 15 wherein the inner and outer casings are joined at least at a gas inlet position.

18. A valveless pulse combustor as claimed in claim 1 wherein the casing bends through an included angle .alpha. between an inlet and an outlet of the combustor.

19. A valveless pulse combustor as claimed in claim 18 wherein the included angle .alpha. is in the range 0.degree. to 180.degree.

20. A valveless pulse combustor as claimed in claim 1 wherein the throat is arranged downstream of the inlet of the inlet pipe or downstream of the tailpipe.

21. A valveless pulse combustor casing as claimed in claim 1 wherein the at least one annular ejector comprises first and second annular ejectors, the second ejector being spaced axially from the first ejector.

22. A valveless pulse combustor casing as claimed in claim 21 wherein the casing is formed as a tubular casing.

23. A valveless pulse combustor casing as claimed in claim 21 wherein the casing is formed as an inner casing and an outer casing.

24. A valveless pulse combustor casing as claimed in claim 23 wherein each of the inner and outer casings has first and second annular ejectors.

25. A valveless pulse combustor casing as claimed in claim 23 wherein the inner and outer casings are joined at least at a gas inlet position.

26. A valveless pulse combustor as claimed in claim 21 wherein the casing bends through an included angle .alpha. between an inlet and an outlet of the combustor.

27. A valveless pulse combustor casing as claimed in claim 26 wherein the included angle .alpha. is in the range 0.degree. to 180.degree.

28. A valveless pulse combustor as claimed in claim 1, further comprising an annular ejector axially aligned with the outlet of the tailpipe.

* * * * *